United States Patent [19]

Peppel

[11] 4,134,569

[45] Jan. 16, 1979

[54] AUTOMATIC CORE GATE

[75] Inventor: George W. Peppel, Farmers Branch, Tex.

[73] Assignee: Ameron, Inc., Monterey Park, Calif.

[21] Appl. No.: 824,056

[22] Filed: Aug. 12, 1977

[51] Int. Cl.[2] ..... B28B 7/30

[52] U.S. Cl. ..... 249/179; 249/153; 249/183

[58] Field of Search ..... 249/153, 178, 179, 183, 249/185

[56] References Cited

U.S. PATENT DOCUMENTS

| | | | |
|---|---|---|---|
| 3,164,877 | 1/1965 | Lee | 249/179 |
| 3,656,732 | 4/1972 | St. John | 249/179 |

*Primary Examiner*—Francis S. Husar
*Assistant Examiner*—John McQuade
*Attorney, Agent, or Firm*—Christie, Parker & Hale

[57] ABSTRACT

A gate for opening and closing a longitudinal joint of a core used in casting concrete pipe has a pair of hinge plates pivotally connected to each side of the core adjacent the joint. A pair of over-center links pivotally connect to the hinge plates and to a pair of coordinator links. The coordinator links pivotally connect, as well, to a displaceable one of the core sides. A remotely controlled actuator acting between the hinge plates and the over-center links opens and closes the gate. The pivotal connections of the coordinator links to the displaceable side of the core, the coordinator links to the over-center links, and the over-center links to the hinge plates are such that in a closed position with both sides of the core abutting and with opening rotation of the over-center links about their pivot with the hinge plates, the pivot between the over-center links and the coordinator links during opening first passes through center before moving away from the joint. With continued opening, the over-center links rotate and carry with them the coordinator links and displaceable core side. The position of the pivot between the hinge plates and the over-center links is eccentric and can be varied by a wheel rotatable with respect to the hinge plate and pin locked. Opening and closing of the gate is preferably by an actuator acting between the hinge plates and the over-center links.

10 Claims, 5 Drawing Figures

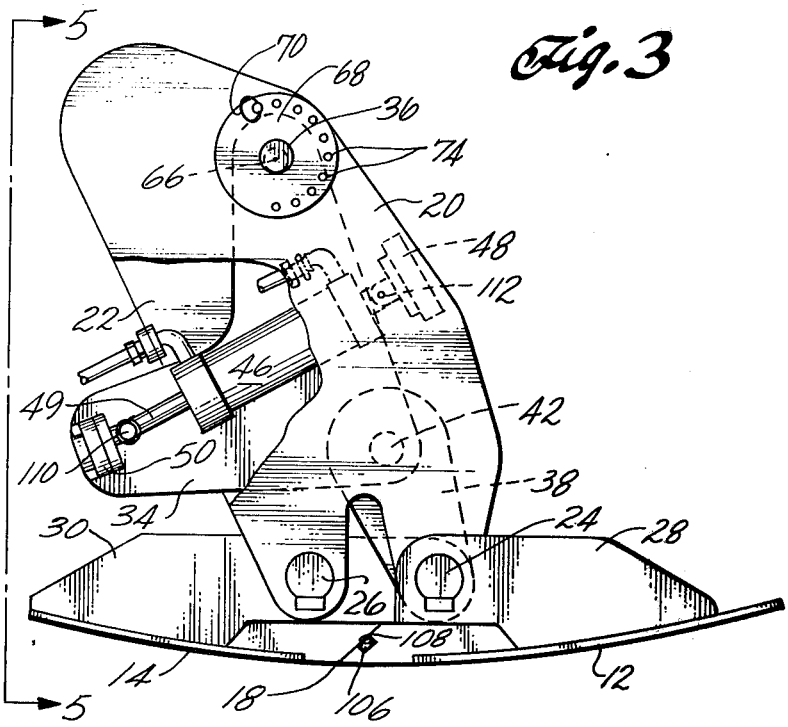
Fig. 3
Fig. 4
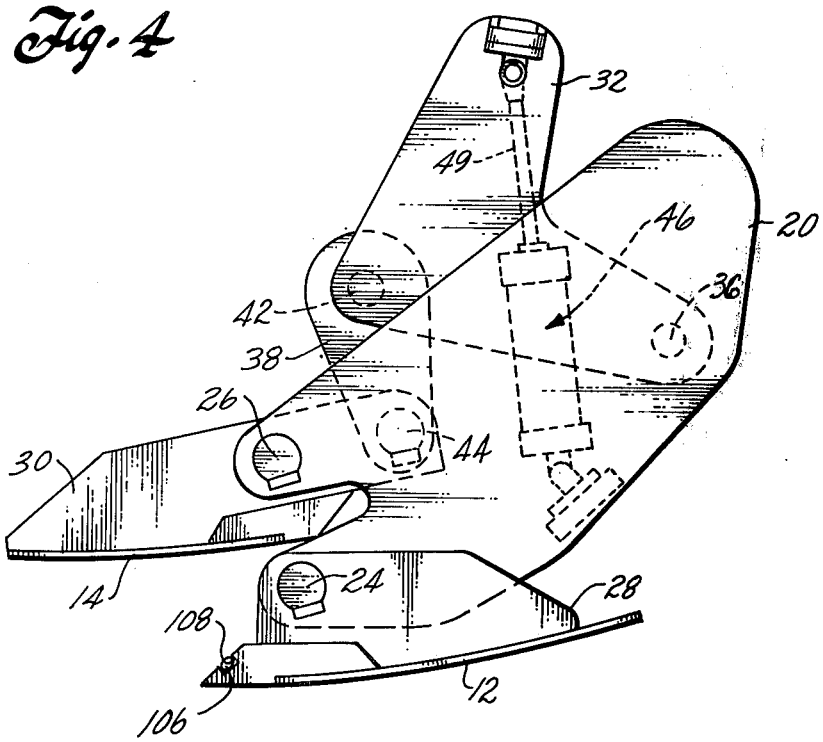

AUTOMATIC CORE GATE

BACKGROUND OF THE INVENTION

The present invention relates to concrete cores used in the fabrication of concrete pipe, and, more in particular, to such a core and a gate used to open and close it.

A core of a concrete mold defines the interior surface of a concrete pipe. During casting, the core provides a barrier for wet concrete. After casting, it is necessary to break down the core and remove it. This requires a reduction of the core's diameter so as to free it from the interior walls of the cast pipe. In the past, concrete pipe cores have been contractable to a smaller diameter for withdrawal from a cast pipe. During the casting process the core has to be of adequate strength to withstand the radial inward pressure placed on it by concrete. Wedges have been used to lock the core gates closed. Existing techniques requiring personnel to drive wedges and the like constitute a safety hazard.

SUMMARY OF THE INVENTION

The present invention provides a remotely actuatable core gate and core for casting concrete pipe which readily breaks down along a longitudinal joint for removing the core from cast pipe and provides a strong joint during the casting process.

One form of the present invention contemplates a core on two sides separated by a longitudinal joint. A hinge plate pivotally connects to each side across the joint so as to straddle the joint with the pivotal connections. One of the core sides is displaceable relative to the other. An over-center link pivotally connects to the hinge plate, and a coordinator link pivotally connects to the over-center link and the displaceable side of the core. The over-center link and coordinator link define an over-center linkage which requires the pivot between the coordinator and over-center links to pass through center during opening of the gate. Remotely controllable means, such as a fluid actuator, act between the hinge plate and the over-center link to rotate the latter about the pivot between the two to pull radially inward on the coordinator link and displace the displaceable side of the core radially inward. At the same time the hinge plate rotates so that its pivot with the displaceable side of the core also moves inwardly to free the core of the inside of the concrete pipe. As stated in different words previously, the pivots between the over-center link and the hinge plate, between the hinge plate and the coordinator link and between the coordinator link and the fixed side of the core are arranged such that the pivot between the over-center link and the coordinator link must pass through a center of least resistance during the opening of the core. This provides an automatic lock feature. The position of the pivot between the over-center link and the hinge plate can be varied slightly so as to adjust the position of the core sides and the pressure on a seal of the joint.

Usually more than one gate for a core is used and the gates coordinate through a coordinator shaft connecting the hinge plates. Preferably the joint between the two sides of the core is at an angle to both a radius of the core and a tangent to the surface of the core so that when the core sides join they do so with positive pressure between the two effected by the gate. It is also preferred to form the hinge plate, over-center link and coordinator link as pairs of these elements so that the actuator can be placed centrally of them with balanced loading.

These and other features, aspects and advantages of the present invention will become more apparent from the following description, appended claims and drawings.

BRIEF DESCRIPTION OF THE DRAWINGS

FIG. 3 illustrates in top plan view, partly broken away, the gate and core of the previous Figures with the core closed;

FIG. 4 is a view similar to FIG. 3, but showing the gate and the core open; and

DESCRIPTION OF THE PREFERRED EMBODIMENTS

Figure 1:
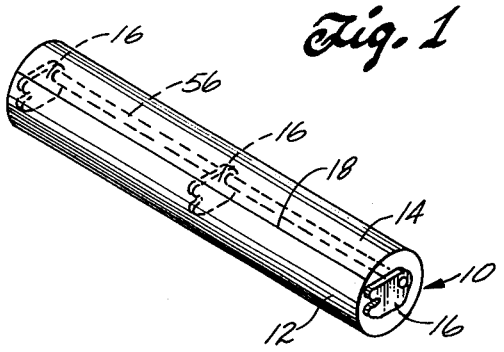
FIG. 1 illustrates a core and core gate construction of the present invention in perspective and in very general terms.

With reference to FIG. 1, a core 10 has a fixed side 12 and a displaceable side 14. A plurality of gates 16 operate to open and close the core sides. The core sides are opened by displacing displaceable side 14 radially inward of the core with respect to side 12 along a longitudinal joint 18 of the core. When closed the joint seals. Opening and closing is by fluid powered actuators (not shown in FIG. 1).

Figure 2:
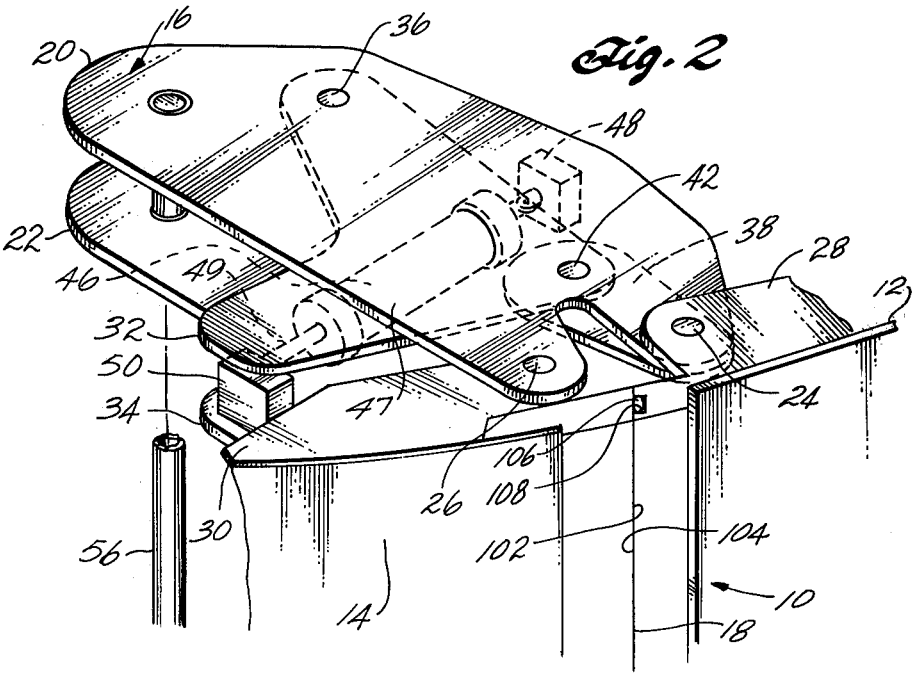
FIG. 2 illustrates a portion of the core gate and core of FIG. 1 perspectively and in greater detail.

FIG. 2 shows a construction of gate 16 in greater detail. The gate has a pair of hinge plates 20 and 22 pivotally connected to core sides 12 and 14 by pivot pins 24 and 26. These pins mount to core sides 12 and 14 in clevis 28 and tongue 30, respectively. The clevis and tongue attach to their respective sides of the core by welding.

When hinge plates 20 and 22 rotate clockwise in FIG. 2 about pin 24, they draw core side 14 radially inward of the core and break the seal of joint 18.

A pair of over-center links 32 and 34 sandwich between plates 20 and 22 and pivotally connect to these plates by a pivot pin 36. The hinge plates also pivotally connect to a pair of coordinating links 38 and 40 (the latter seen in FIG. 5) at a pivot pin 42, with the coordinating links sandwiched between the over-center links. The coordinating links in turn pivotally connect to displaceable side 14 by a pivot pin 44 (shown best in phantom in FIG. 4).

An actuator 46 rotates over-center link pair 32 and 34 about pin 36 and rotates hinge plates 20 and 22 about pin 24. The actuator has a cylinder 47 pivotally connected to a block 48. This block attaches to hinge plates 20 and 22. A power shaft 49 of the actuator pivotally attaches to over-center links 32 and 34 at a block 50 attached to these links.

Upon actuation of the actuator, power shaft 49 extends from cylinder 47 with the effect of rotating the hinge plates and over-center links with respect to each other about pin 36. Pivot 42 will first rotate through a center corresponding to a straight line through the axes of pins 24 and 36 before exerting a breaking force on joint 18. After center, pin 42 travels radially inward from joint 18. Thus the hinge plates and over-center links form an over-center linkage. Upon rotation away from joint 18, coordinator links 38 and 40 through pin 44 pull radially inward on core side 14. At this time, hinge plates 20 and 22 rotate about pin 24 and pull radially inward on core side 14 through pin 26. Side 14 moves radially inward in response to these urgings in about parallel relationship with the core side 14. This is, there is not much turning of one core side with respect to the other during this opening. Core side 14 moves considerably tangentially and parallel to side 12 during later stages of opening. During these actions the various of the gates coordinate to operate in unison by a coordinator 56 acting between them.

Figure 5:
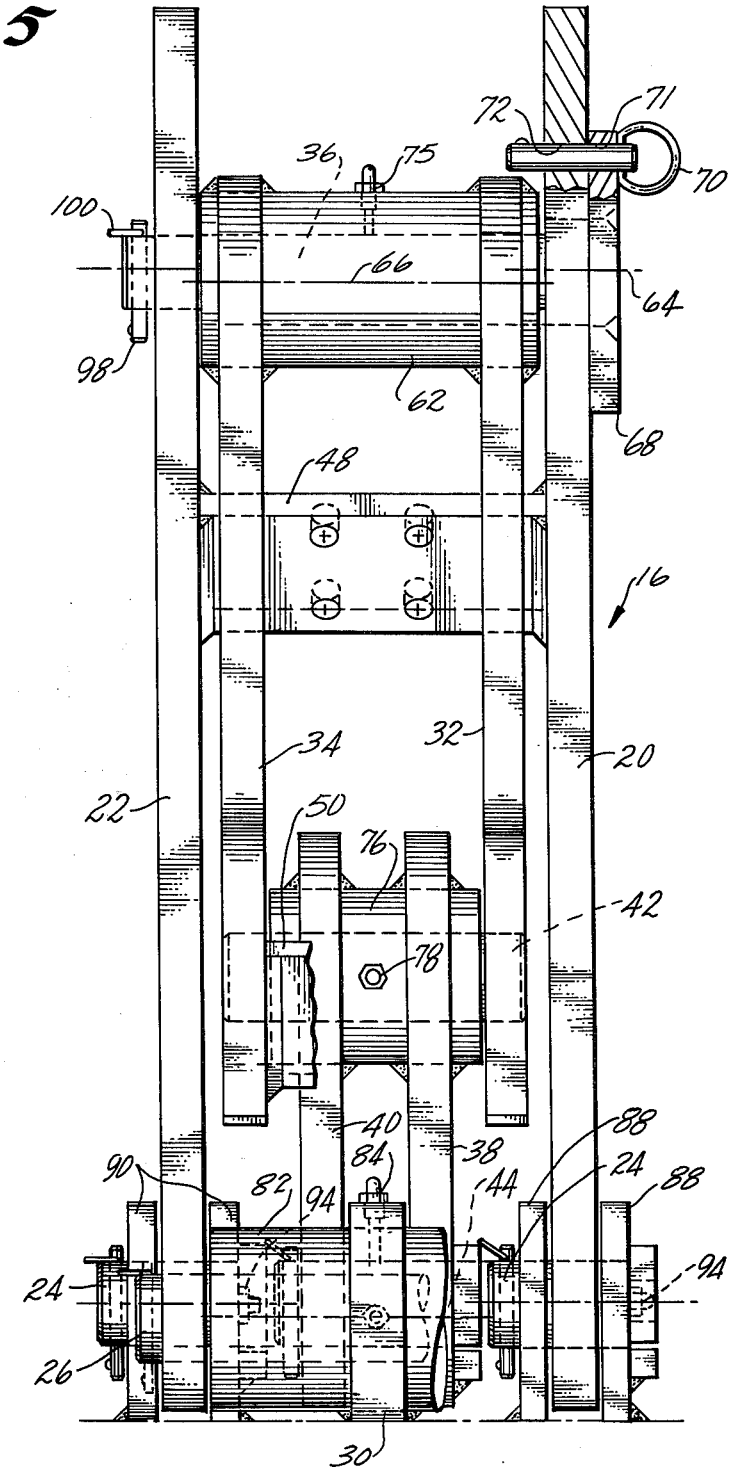
FIG. 5 is a view taken along line 5—5 of FIG. 3 illustrating the gate in a side view. Portions of the gate are broken away for clarity.

With reference to FIG. 5, the detail construction of gate 16 is more readily seen.

Hinge plates 20 and 22 parallel each other and sandwich between them over-center links 32 and 34 and coordinator links 38 and 40.

As seen in FIG. 5, pivot pin 36 journals in a sleeve 62 welded to over-center links 32 and 34. The pin also journals in hinge plates 20 and 22. Pin 36 journals in plates 20 and 22 for rotation with respect to these plates about an axis 64. As can be seen by the phantom lines outlining a head of pin 36 within plate 20 and phantom lines outlining a shank of the pin within sleeve 62, the axis of the head of the pin is offset from the axis of the shank of the pin. This displacement defines the offset of axis 64 from axis 66. The offset forms an eccentric. Pin 36 forms a pivotal axis for over-center links 32 and 34 about an offset axis 66. A plate 68 attaches to pin 36 and has a plurality of holes in it for registration with holes in plate 20 and the securing of plate 68 to plate 20 by a key 70 in aligned of the holes. A pair of aligned holes 71 and 72 are shown in FIG. 5. The family of the holes is shown in FIG. 3 at 74. Rotation of plate 68 rotates axis 66 with respect to axis 64 and therefore the pivotal axis of the over-center links with respect to the hinge plates, coordinator links and over-center link pivot 42, and hinge plate-to-core side pivot 24. This adjustment offsets the over-center between the coordinator links and the hinge plates. A grease fitting 75 allows lubrication of shaft 36 within sleeve 62.

Actuator 46 attaches to the hinge plates and the over-center links blocks 48 and 50.

Block 48 secures to hinge plates 20 and 22 by welding. Block 50 secures to over-center links 32 and 34 as by welding.

Coordinator links 38 and 40 pivotally connect to over-center links 32 and 34 by pin 42. This pin receives in journals in the over-center links and in a sleeve 76. A grease fitting 78 permits lubrication of the bearing surfaces of the sleeve and pin. Sleeve 76 secures to coordinating links 38 and 40 by welding. Links 38 and 40 receive pin 44 and secure to displaceable core side 14 by the journaled receipt of pin 44 in tongue 30 of the displaceable core side. A sleeve 82 welded onto this tongue spans the gap between hinge plates 22 and 20 and journals pivot 26 between the hinge plates and the displaceable core side. A grease fitting 84 permits lubrication of the bearing surfaces between the bore of sleeve 82 and pin 26. Coordinating links 38 and 40 coact with the hinge plates at pivot 26 to draw the displaceable core side radially inward of the core without much tangential displacement of the core side during the first part of the draw.

Hinge plates 20 and 22 couple to stationary core side 12 by clevis plates 88 and 90 of clevis 28. Pin 24 is split for clearance of the coordinating links and tongue 30. Grease fittings 94 allow lubrication of the bearing surfaces between the hinge plates and clevis plates 90 and 92. All the pertinent pins constituting the pivots of the invention are keyed against motion along their axes by detent pins. The arrangement for pin 36 is typical. There, a detent pin 98 is received in a cross slot of the pin 36 and is cotter keyed at 100.

Joint 18 constitutes abutting surfaces 102 and 104 of displaceable and fixed core sides 14 and 12. A seal 106 in a channel 108 extends the length of the joint and seals the joint.

All the pivots of the gate are parallel to each other and the longitudinal axis of the core.

As seen in FIG. 3, power shaft 49 of actuator 46 pivotally connects to block 50 by a pin joint 110 formed of a clevis, tongue and pin. A similar joint 112 between block 48 and actuator 46 defines the pivotal connection there.

In operation, assuming the core gate is closed, then core sides 12 and 14 abut to form joint 18 and the joint is sealed. For a single gate the arrangement looks like it does in FIG. 3. It will be noted there that hinge plate 20 cannot be moved by action of the actuator on it and the over-center links until coordinator link 38 has rotated enough to require displacement of pin 26 radially inward of the core. This is an over-center lock feature. In the closed position and with continued reference to FIG. 3, pivot 42 is slightly to the right of a line passing through pivots 24 and 36. In other words, the over-centered link and coordinator link move in response to actuator 46. The hinge plates do not move initially, and the hinge plates must rotate towards the gate. During the very first part of the rotation, the over-centered link and coordinator link tend to extend the distance between pivot 36 and pivot 44 (see FIG. 4) and this is resisted by joint 18. Since joint 18 resists extension of the distance between pins 36 and 44 there is an over-center-like action. Actuation of the actuator to force power shaft 49 to extend rotates the hinge plates clockwise in FIG. 3 about pin 24 and rotates over-center link 34 clockwise about pin 36 in that Figure. Coordinator link 38 through pin 42 follows the over-center link. This means that both pins 26 and 24 move radially inward pulling displaceable core side 14 with them. Fully developed expansion of the actuator shown in FIG. 4 has displaceable core side 14 moved appreciably inward of fixed core side 12. There has also been an overlapping of the core side ends to further contract the core diameter. All gates act in unison because coordinator 56 forces them to. Closing the gate reverses the procedure. The actuator and over-center feature permit remote opening and closing of the gate, the latter with a lock. By forming the hinge plate, over-center links, and coordinator links in spaced, parallel pairs, actuator 46 is centrally disposed and the gate components are evenly stressed by the actuator. No distortion of the sides of the core forming joint 18 results.

The present invention has been described with reference to a preferred embodiment. The spirit and scope of the appended claims should not, however, necessarily be limited to the foregoing description.

I claim:

1. An improved core and core gate used in casting concrete pipes comprising:

(a) a core defining in a closed position a longitudinal joint flanked by two core sides, one of the sides being displaceable relative to the other between an open and a closed position;

(b) a gate including:

(i) a hinge plate pivotally connected at a first pivot to the displaceable side of the core and at a second pivot to the other side of the core across the joint with the pivot axes paralleling the axis of the core, the hinge plate being pivotal between an open and a closed position;

(ii) an over-center link pivotally connected to the hinge plate for pivotal rotation between an open and a closed position;

(iii) a coordinator link pivotally connected to the over-center link and to the displaceable core side for pivotal rotation between an open and a closed position, the pivotal connections of the coordinator link being such that the coordinator link and the over-center link form an over-center linkage in the closed position of the core with a center that must be passed through during opening of the core; and (iv) a remotely actuatable actuator means between the over-center link and the hinge plate to open and close the core, respectively, by rotating the over-center link from its closed position about its pivot with the hinge plate past the center of the over-center linkage to the open position and to force the displaceable core side radially inward of the core, and rotating the over-center link from its open position about its pivot with the hinge plate to force the displaceable core side radially outward and form the longitudinal joint and past and center of the over-center linkage to the closed position.

2. The improved core and core gate claimed in claim 1 wherein the joint is defined by abutting walls of the core sides that abut along a surface that lies at an acute angle to both a radius of the core that intersects the joint and a tangent to the core that intersects this radius.

3. The improved core and core gate claimed in claim 2 wherein over-center adjustment means is provided to adjust the center of the over-center linkage formed of the over-center link and the coordinator link.

4. The improved core and core gate claimed in claim 3 wherein the over-center adjustment means includes the pivot between the hinge plate and the over-center link, the pivot being defined by a pin with offset rotational axes for the hinge plate and the over-center link.

5. An improved core and core gate for use in casting concrete pipes comprising:

(a) a core having a longitudinal axis and first and second sides defining a longitudinal closed joint throughout the length of the core in a core closed position, the second side being displaceable radially inwardly and angularly with respect to the center of the core and relative to the first side to develop an overlap of the sides in a core open position;

(b) a pair of parallel and spaced-apart hinge plates of the gate pivotally connected at a first pivotal connection to the first core side and at a second pivotal connection to the second core side for rotation between an open and a closed position about the first pivotal connection, such rotation rotating the second core side about the first pivotal connection by the hinge plates acting on the second pivotal connection;

(c) a pair of parallel and spaced-apart over-center links of the gate pivotally connected to the hinge plates;

(d) a pair of parallel and spaced-apart coordinator links of the gate pivotally connected to the over-center links and the second core side, the pivotal connections between the over-center links and the hinge plates, between the over-center links and the coordinator links, and between the coordinator links and the second core side in a gate-closed position defining an over-center linkage requiring the pivotal connection between the coordinator links and the over-center links to pass through the center of such linkage during the opening and the closing of the gate;

(e) remotely controlled actuator means of the gate centrally disposed in the space between the hinge plates, over-center links and coordinator links and pivotally connected between the hinge plates and the over-center links such that in an opening, actuation direction with the hinge plates, over-center links, and coordinator links in their closed positions, the over-center links rotate about their pivotal connection with the hinge plates to rotate the pivotal connection between the coordinator links and the over-center links through the center, to thereby rotate the hinge plates about their first pivotal connection and to draw the second core side through the second pivotal connection radially inward of the first core side and angularly with respect to the center of the core and the first core side to develop the overlap of the core sides, the actuator means acting in an opposite and closing direction reversing these motions to define the closed joint.

6. The improved core and core gate claimed in claim 5 wherein the coordinator links pivotal connection to the second core side is spaced angularly with respect to the center of the core from the pivotal connection of the hinge plates to the second core side to effect essentially radial of the core motion of the second core side during the initial portion of its opening and during the final portion of its closing.

7. The improved core and core gate claimed in claim 6 wherein there are at least two gates on the joint and including coordinator means between the hinge plates thereof to effect coordinated motion of the hinge plates.

8. The improved core and core gate claimed in claim 7 including eccentric pivot pin means defining the pivot between the over-center links and the hinge plates, the eccentric pivot means providing adjustment means of the over-center linkage to adjust the position of the center of such linkage.

9. The improved core and core gate claimed in claim 8 wherein the joint is defined by abutting walls of the core sides that abut along a surface at an angle to both the radius of the core and a tangent to the radius.

10. The improved core and core gate claimed in claim 9 wherein the actuator means is a fluid actuator means.

* * * * *

UNITED STATES PATENT AND TRADEMARK OFFICE

CERTIFICATE OF CORRECTION

PATENT NO. : 4,134,569

DATED : January 16, 1979

INVENTOR(S) : George W. Peppel

It is certified that error appears in the above-identified patent and that said Letters Patent are hereby corrected as shown below:

In the specification: Column 3, line 5, "This" should be --That--; Column 3, lines 21 through 26, delete "As can be seen by the phantom lines outlining a head of pin 36 within plate 20 and phantom lines outlining a shank of the pin within sleeve 62, the axis of the head of the pin is offset from the axis of the shank of the pin. This displacement defines the offset of axis 64 from axis 66. The offset forms an eccentric."; Column 3, line 28, after "66" insert --As can be seen by the phantom lines outlining a head of pin 36 within plate 20 and phantom lines outlining a shank of the pin within sleeve 62, the axis of the head of the pin is offset from the axis of the shank of the pin. This displacement defines the offset of axis 64 from axis 66. The offset forms an eccentric.--

In the claims: Claim 1, column 5, line 31, "and", second occurrence, should be --the--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*